US011695238B2

(12) United States Patent
Migliorino et al.

(10) Patent No.: US 11,695,238 B2
(45) Date of Patent: Jul. 4, 2023

(54) CABLE PULL TAB

(71) Applicant: Veea Inc., New York, NY (US)

(72) Inventors: Robert Migliorino, Wayne, NJ (US); Michael Mirabella, Iselin, NJ (US); Shaun Joseph Greaney, Freehold, NJ (US); Michael Liccone, Scotch Plains, NJ (US)

(73) Assignee: VEEA INC., New York, NY (US)

( * ) Notice: Subject to any disclaimer, the term of this patent is extended or adjusted under 35 U.S.C. 154(b) by 53 days.

(21) Appl. No.: 17/342,191

(22) Filed: Jun. 8, 2021

(65) Prior Publication Data

US 2021/0384675 A1 Dec. 9, 2021

Related U.S. Application Data

(60) Provisional application No. 63/036,241, filed on Jun. 8, 2020.

(51) Int. Cl.
*H01R 13/633* (2006.01)
*H01R 13/50* (2006.01)

(52) U.S. Cl.
CPC ..... *H01R 13/6335* (2013.01); *H01R 13/501* (2013.01)

(58) Field of Classification Search
CPC .. H01R 13/501; H01R 13/639; H01R 4/2433; H01R 13/447; H01R 13/502; H01R 13/5205; H01R 13/5829; H01R 13/633; H01R 13/6592; H01R 2103/00; H01R 12/675; H01R 13/46; H01R 13/52; H01R 13/582; H01R 13/5825; H01R 13/6272; H01R 13/6315; H01R 2107/00; H01R 2201/04; H01R 24/62; H01R 24/64; H01R 4/646; H01R 13/02; H01R 13/518; H01R 13/523; H01R 13/58; H01R 13/5804; H01R 13/642; H01R 13/648; H01R 2201/18; H01R 11/284; H01R 13/68; H01R 12/7058; H01R 12/721; H01R 12/79; H01R 13/08; H01R 13/2442; H01R 13/35; H01R 13/50; H01R 13/506; H01R 13/514; H01R 13/5837; H01R 13/6397; H01R 2201/12;
(Continued)

(56) References Cited

U.S. PATENT DOCUMENTS 3,753,410 A * 8/1973 Kostenowczyk ..... H01R 13/62
4,784,610 A * 11/1988 Stuart ..... H01R 13/633 174/67

(Continued)

*Primary Examiner* — Truc T Nguyen
(74) *Attorney, Agent, or Firm* — The Marbury Law Group, PLLC

(57) ABSTRACT

Various embodiments include a connector head assembly for an electrical cable attached to one or more receptacle connectors. The connector head assembly may include an elongate overmold having a longitudinal extent that is longer than a height or width thereof. The elongate overmold may be configured to encase a terminal end of the electrical cable coupled to the one or more receptacle connectors inside the elongate overmold. The connector head assembly may also include a pull tab pivotally attached to the elongate overmold on an upper surface thereof. A pulling force applied to the pull tab may be configured to separate the receptacle connector from a receptacle in which the receptacle connector is configured to be held.

18 Claims, 8 Drawing Sheets

(58) Field of Classification Search
CPC .... H01R 2201/26; H01R 24/28; H01R 24/68; H01R 24/78; H01R 25/14; H01R 27/02; H01R 4/2429; H01R 43/0428; H01R 43/048; H01R 11/14; H01R 11/22; H01R 11/282; H01R 12/594; H01R 12/75; H01R 12/772; H01R 12/78; H01R 13/4223; H01R 13/4361; H01R 13/453; H01R 13/5202; H01R 13/5213; H01R 13/5833; H01R 13/5845; H01R 13/6205; H01R 13/267; H01R 13/6273; H01R 13/62927; H01R 13/62933; H01R 13/62944; H01R 13/62977; H01R 13/6335; H01R 13/6582; H01R 13/6588; H01R 13/6589; H01R 13/66; H01R 13/701; H01R 13/7031; H01R 13/72; H01R 2201/06; H01R 25/00; H01R 25/142; H01R 25/162; H01R 4/2416; H01R 4/5016; H01R 4/5083; H01R 4/52; H01R 43/05; H01R 43/052; H01R 43/055; H01R 9/0506; H01R 9/0509; H01R 9/0515; H01R 9/0518; H01R 9/053; H01R 9/22; H01R 9/2441
See application file for complete search history.

(56) References Cited

U.S. PATENT DOCUMENTS

| | | | | |
|---|---|---|---|---|
| 5,759,066 | A * | 6/1998 | Okabe | H01R 13/501 439/682 |
| 5,871,374 | A * | 2/1999 | Maney | H01R 13/501 439/696 |
| 6,430,053 | B1 * | 8/2002 | Peterson | H01R 13/6335 361/740 |
| 6,786,653 | B1 * | 9/2004 | Hwang | H05K 9/0058 385/92 |
| 9,246,262 | B2 * | 1/2016 | Brown | H01R 13/62 |
| 10,191,229 | B2 * | 1/2019 | Matsui | G02B 6/4292 |
| 2003/0100390 | A1 * | 4/2003 | Masao | H01R 13/62 |
| 2014/0273593 | A1 * | 9/2014 | Aekins | H01R 13/633 439/354 |
| 2014/0335711 | A1 * | 11/2014 | Lamb | B60L 3/04 439/258 |
| 2015/0200491 | A1 * | 7/2015 | Fries | H01R 13/639 439/372 |
| 2016/0322750 | A1 * | 11/2016 | Plamondon | H01R 13/6272 |

* cited by examiner

CABLE PULL TAB

RELATED APPLICATIONS

This application claims the benefit of priority to U.S. Provisional Patent Application No. 63/036,241 entitled "Cable Pull Tab" filed Jun. 8, 2020, the entire contents of which is hereby incorporated by reference for all purposes.

BACKGROUND

Wireless communication technologies have been growing in popularity and use over the past several years. This growth has been fueled by better communications hardware, larger networks, and more reliable protocols. Wireless and Internet service providers are now able to offer their customers with an ever-expanding array of features and services, such as robust cloud-based services.

To better support these enhancements, more powerful consumer facing edge devices (e.g., consumer grade access points, IoT gateways, routers, switches, etc.) are beginning to emerge. These devices include more powerful processors, system-on-chips (SoCs), memories, antennas, power amplifiers, and other resources (e.g., power rails, etc.) that better support high-speed wireless communications and execute complex and power intensive applications facilitating edge computing.

In addition to high performance and functionality, consumers increasingly demand that their devices be affordable, future-proof (e.g., upgradeable, highly versatile, etc.) and small enough to readily placed throughout a home or small office. New and improved cables, connectors and interfaces will be beneficial to consumers and such consumer facing edge devices.

SUMMARY

Various embodiments include a connector head assembly for an electrical cable attached to one or more receptacle connectors. The connector head assembly may include an elongate overmold having a longitudinal extent that is longer than a height or width thereof. The elongate overmold may be configured to encase a terminal end of the electrical cable coupled to the one or more receptacle connectors inside the elongate overmold. The connector head assembly may also include a pull tab pivotally attached to the elongate overmold on an upper surface thereof. A pulling force applied to the pull tab may be configured to separate the receptacle connector from a receptacle in which the receptacle connector is configured to be held.

In some embodiments, the elongate overmold and the pull tab may be integrally formed such that the pivotal attachment of the pull tab is formed as a living hinge integrated into an outer surface of the elongate overmold. The elongate overmold and the pull tab may be integrally formed such that the pivotal attachment of the pull tab is formed as a living hinge integrated into an outer surface of the elongate overmold. The pull tab may pivot from an open position, in which the pull tab extends away from an upper surface of the elongate overmold, to a closed position, in which the pull tab extends parallel to the longitudinal extent. At least a portion of the handle may be configured to sit below an upper surface of the elongate overmold when the handle is in the closed position. The pull tab may be formed as a separate part from the elongate overmold and releasably attaches to the elongate overmold.

In some embodiments, an attachment portion of the pull tab may slide onto a mating structure of the elongate overmold, preventing relative movement between the attachment portion and the elongate overmold in a direction perpendicular to the longitudinal extent. The pull tab may include the attachment portion that is configured to remain stationary relative to the elongate overmold, and a pivotal portion that is configured to pivot relative to the elongate overmold. The attachment portion and the pivotal portion may be integrally formed such that the pivotal attachment of the pull tab is formed as a living hinge attaching the attachment portion to the pivotal portion. the pivotal portion is configured to pivot into a closed position in which the pivotal portion covers an upper surface and at least one side surface of the elongate overmold. The pivotal portion may include at least one side wall, wherein the at least one side wall is configured to sit below an upper surface of the elongate overmold when the pivotal portion is in the closed position. The pivotal portion may include two opposed side walls, wherein the two opposed side walls are configured to sit below an upper surface of the elongate overmold when the pivotal portion is in the closed position.

In some embodiments, the elongate overmold may be further configured to receive the electrical cable through an aperture in a first end of the elongate overmold, wherein the electrical cable is configured to extend through the aperture, parallel to the longitudinal extent. The elongate overmold may be further configured to hold the receptacle connector extending from a bottom side of the elongate overmold near a second end thereof that is opposed to the first end. The receptacle connector may be a USB-C power bank connector.

In some embodiments, the elongate overmold may include a longitudinal extent that is longer than a height or width thereof. The elongate overmold may be configured to encase a terminal end of the electrical cable coupled to the one or more receptacle connectors inside the elongate overmold. The terminal end of the one or more receptacle connectors may protrude from a first portion of an underside of the elongate overmold in a direction perpendicular to the longitudinal extent. A second portion of the underside may include a cavity configured to receive a portion of a finger for applying a force in the direction perpendicular to the longitudinal extent.

In some embodiments, an arch on the underside of the elongate overmold forms the cavity. The width of the elongate overmold may be wider at the second portion than at the first portion. The connector head assembly may be configured to fit within a channel in a housing base, wherein a lateral side of the elongate overmold includes a key element configured to mate with a matching key element in the channel of the housing base.

BRIEF DESCRIPTION OF THE DRAWINGS

The accompanying drawings, which are incorporated herein and constitute part of this specification, illustrate exemplary embodiments of the claims, and together with the general description given above and the detailed description given below, serve to explain the features of the claims.

DETAILED DESCRIPTION

Figure 1A:
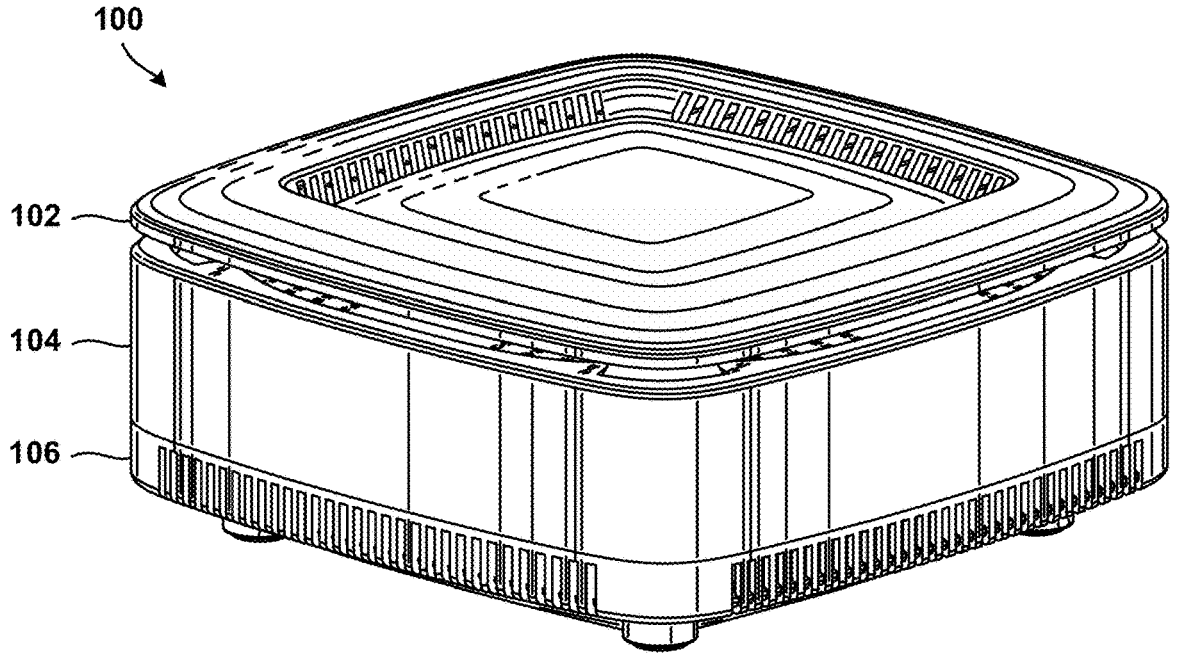
FIGS. 1A-1C are a top perspective view, a bottom perspective view, and a bottom plan view, respectively, of a consumer facing edge computing device that could be configured to receive a connector in accordance with various embodiments.

Various embodiments will be described in detail with reference to the accompanying drawings. Wherever possible, the same reference numbers will be used throughout the drawings to refer to the same or like parts. References made to particular examples and embodiments are for illustrative purposes, and are not intended to limit the scope of the claims.

In overview, the embodiments include a modular wireless communications system (e.g., edge device that provides Wi-Fi access points, IoT gateways, etc.) that includes a baseline feature set, and an expandable architecture that allows end users to add specific features or functionality (e.g., digital concierge, home assistant, etc.) to the system as needed. The modular wireless communications system may expose systems buses and resources in a manner that allows the device to be readily expanded. The modular wireless communications system may include an electro-mechanical interface such that system busses and resources may be readily accessed and/or retro-fitted by the end user, after deployment, or in the field. An interface plug may be connected to one of the exposed electro-mechanical interfaces facilitating different connection and interface options.

The various embodiments may include, use, incorporate, implement, provide access to a variety of wired and wireless communication networks, technologies and standards that are currently available or contemplated in the future, including any or all of Bluetooth®, Bluetooth Low Energy, ZigBee, LoRa, Wireless HART, Weightless P, DASH7, RPMA, RFID, NFC, LwM2M, Adaptive Network Topology (ANT), Worldwide Interoperability for Microwave Access (WiMAX), WIFI, WiFi6, WIFI Protected Access I & II (WPA, WPA2), personal area networks (PAN), local area networks (LAN), metropolitan area networks (MAN), wide area networks (WAN), networks that implement the data over cable service interface specification (DOCSIS), networks that utilize asymmetric digital subscriber line (ADSL) technologies, third generation partnership project (3GPP), long term evolution (LTE) systems, LTE-Direct, third generation wireless mobile communication technology (3G), fourth generation wireless mobile communication technology (4G), fifth generation wireless mobile communication technology (5G), global system for mobile communications (GSM), universal mobile telecommunications system (UMTS), high-speed downlink packet access (HSDPA), 3GSM, general packet radio service (GPRS), code division multiple access (CDMA) systems (e.g., cdmaOne, CDMA2000TM), enhanced data rates for GSM evolution (EDGE), advanced mobile phone system (AMPS), digital AMPS (IS-136/TDMA), evolution-data optimized (EV-DO), digital enhanced cordless telecommunications (DECT), etc. Each of these wired and wireless technologies involves, for example, the transmission and reception of data, signaling and/or content messages.

Any references to terminology and/or technical details related to an individual wired or wireless communications standard or technology are for illustrative purposes only, and not intended to limit the scope of the claims to a particular communication system or technology unless specifically recited in the claim language.

The term "computing device" may be used herein to refer to any one or all of quantum computing devices, edge devices, Internet access gateways, modems, routers, network switches, residential gateways, access points, integrated access devices (IAD), mobile convergence products, networking adapters, multiplexers, personal computers, laptop computers, tablet computers, user equipment (UE), smartphones, personal or mobile multi-media players, personal data assistants (PDAs), palm-top computers, wireless electronic mail receivers, multimedia Internet enabled cellular telephones, gaming systems (e.g., PlayStation™, Xbox™, Nintendo Switch™, etc.), wearable devices (e.g., smartwatch, head-mounted display, fitness tracker, etc.), IoT devices (e.g., smart televisions, smart speakers, smart locks, lighting systems, smart switches, smart plugs, smart doorbells, smart doorbell cameras, smart air pollution/quality monitors, smart smoke alarms, security systems, smart thermostats, etc.), media players (e.g., DVD players, ROKU™, AppleTV™, etc.), digital video recorders (DVRs), and other similar devices that include a programmable processor and communications circuitry for providing the functionality described herein.

The term "quantum computing device" may be used herein to refer to a computing device or edge device, whether it is a standalone device or used in conjunction with current computing processes, that generates or manipulates quantum bits (qubits) or which utilizes quantum memory states. A quantum computing device may enhance edge computing capability by providing solutions that would be challenging to implement via conventional computing systems. This is especially true with value added computing for leveraging a diverse amount of sensor and other input data to arrive at a solution in real time. Through unifying diverse data sources a quantum computing solution at the edge may accelerate machine learning, solve complex problems faster as well as provide the fundamental platform for artificial intelligence nodes at the edge of the network. With the vast array of data delivered by sensors as well state information the quantum computing process may improve the memory allocation though the use of superposition allowing for more information to be simultaneously stored and processed.

The term "edge device" may be used herein to refer to a computing device that includes a programmable processor and communications circuitry for establishing communication links to consumer devices (e.g., smartphones, UEs, IoT devices, etc.) and/or to network components in a service provider, core, cloud, or enterprise network. For example, an edge device may include or implement functionality associated any one or all of an access point, gateway, modem, router, network switch, residential gateway, mobile convergence product, networking adapter, customer premise device, multiplexer and/or other similar devices.

The term "system on chip" (SOC) may be used herein to refer to a single integrated circuit (IC) chip that contains multiple resources and/or processors integrated on a single substrate. A single SOC may contain circuitry for digital, analog, mixed-signal, and radio-frequency functions. A single SOC may also include any number of general purpose and/or specialized processors (digital signal processors, modem processors, video processors, etc.), memory blocks (e.g., ROM, RAM, Flash, etc.), and resources (e.g., timers, voltage regulators, oscillators, etc.). SOCs may also include software for controlling the integrated resources and processors, as well as for controlling peripheral devices.

The term "system in a package" (SIP) may be used herein to refer to a single module or package that contains multiple resources, computational units, cores and/or processors on two or more IC chips, substrates, or SOCs. For example, a SIP may include a single substrate on which multiple IC chips or semiconductor dies are stacked in a vertical configuration. Similarly, the SIP may include one or more multi-chip modules (MCMs) on which multiple ICs or semiconductor dies are packaged into a unifying substrate. A SIP may also include multiple independent SOCs coupled together via high speed communication circuitry and packaged in close proximity, such as on a single backplane, single motherboard or in a single wireless device. The proximity of the SOCs facilitates high speed communications and the sharing of memory and resources.

The term "multicore processor" may be used herein to refer to a single integrated circuit (IC) chip or chip package that contains two or more independent processing cores (e.g., CPU core, IP core, GPU core, etc.) configured to read and execute program instructions. A SOC may include multiple multicore processors, and each processor in an SOC may be referred to as a core. The term "multiprocessor" may be used herein to refer to a system or device that includes two or more processing units configured to read and execute program instructions.

FIG. 1A is a perspective view from the top of a modular wireless communications system 100 that includes an LED/LID component 102, a stackable housing 104 for encapsulating its components (e.g., antenna, heatsink, processors, etc.), and a housing base 106.

Figure 1B:
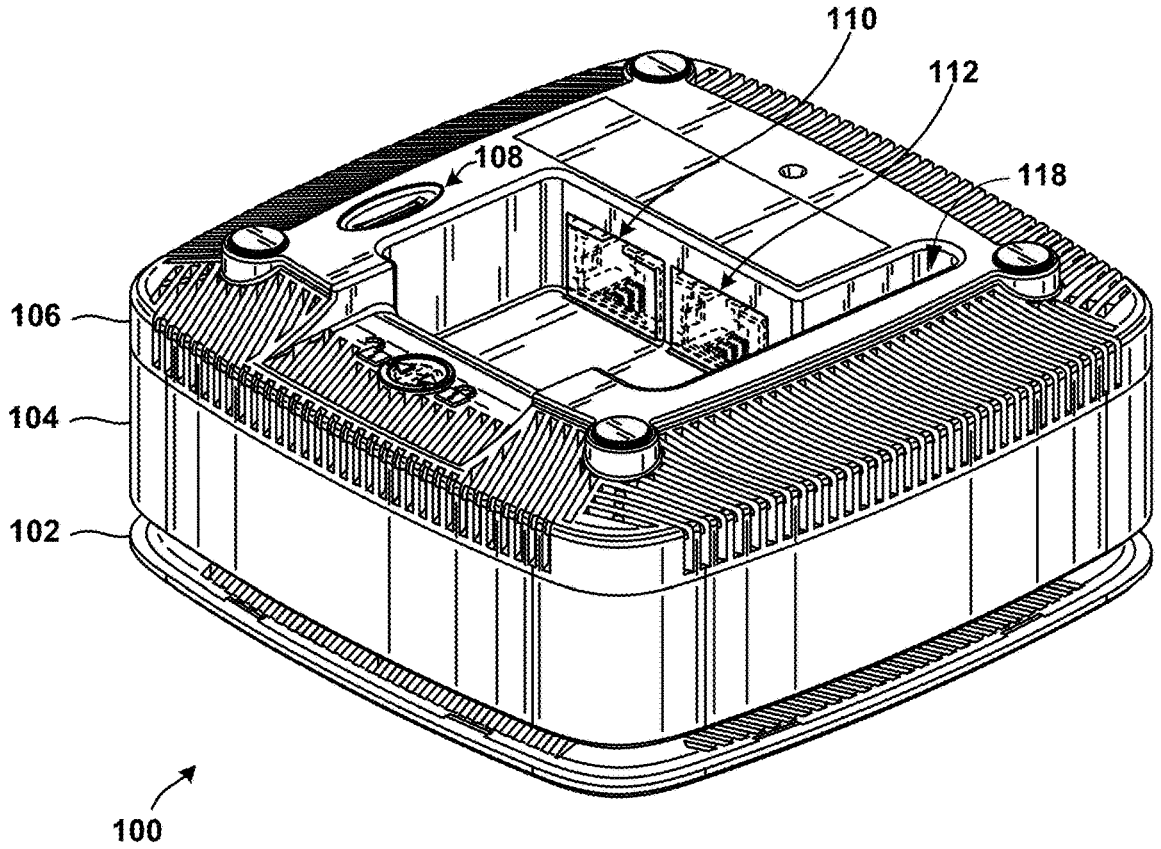

FIG. 1B is a perspective view from the bottom of the modular wireless communications system 100 in FIG. 1A. FIG. 1B illustrates that the housing base 106 may include various connector ports 108, 110, 112 that may be used to couple the components within the stackable housing 104 to other components. A channel 118 is also formed, at the bottom of which are located two additional connectors ports (e.g., 114, 116), which are visible in FIG. 1C.

Figure 1C:
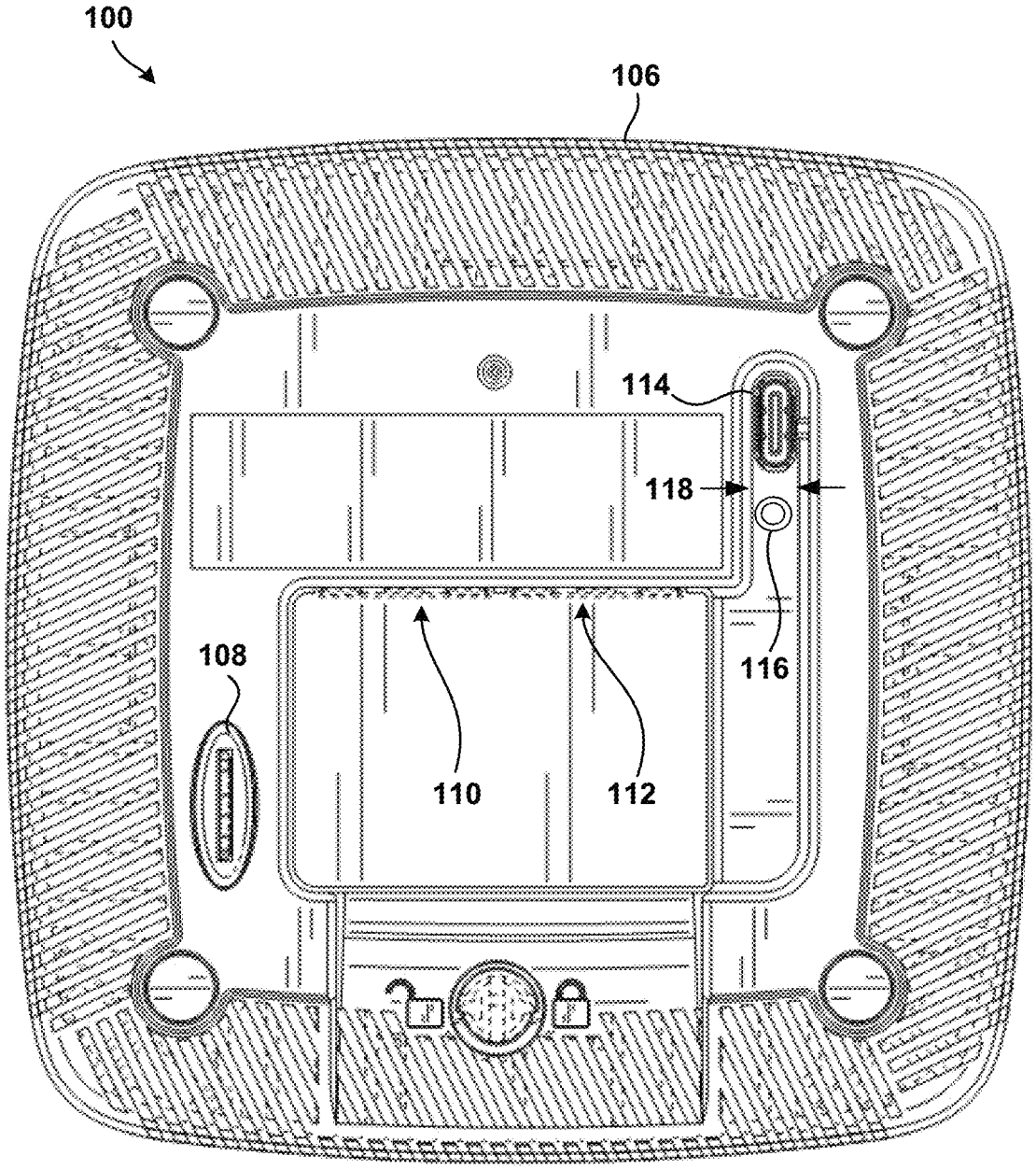

FIG. 1C is a bottom view of the modular wireless communications system 100 in FIGS. 1A and 1B. FIG. 1C illustrates that the housing base 106 with the connector ports 108, 110, 112 visible in FIG. 1B. Additionally, FIG. 1C includes a USB-C type female connector port 114 and an auxiliary power port 116, which may be used to couple the components within the stackable housing (e.g., 104) to other components. In order to maximize space inside the stackable housing, the housing base 106 includes the channel 118. However, due to the narrow nature of the channel 118, removal of the connectors that get plugged into the USB-C type female connector port 114 and the auxiliary power port 116 may be difficult. Thus, various embodiments use customized connector head assemblies, as described below with regard to FIGS. 1A-4D.

Figure 2A:
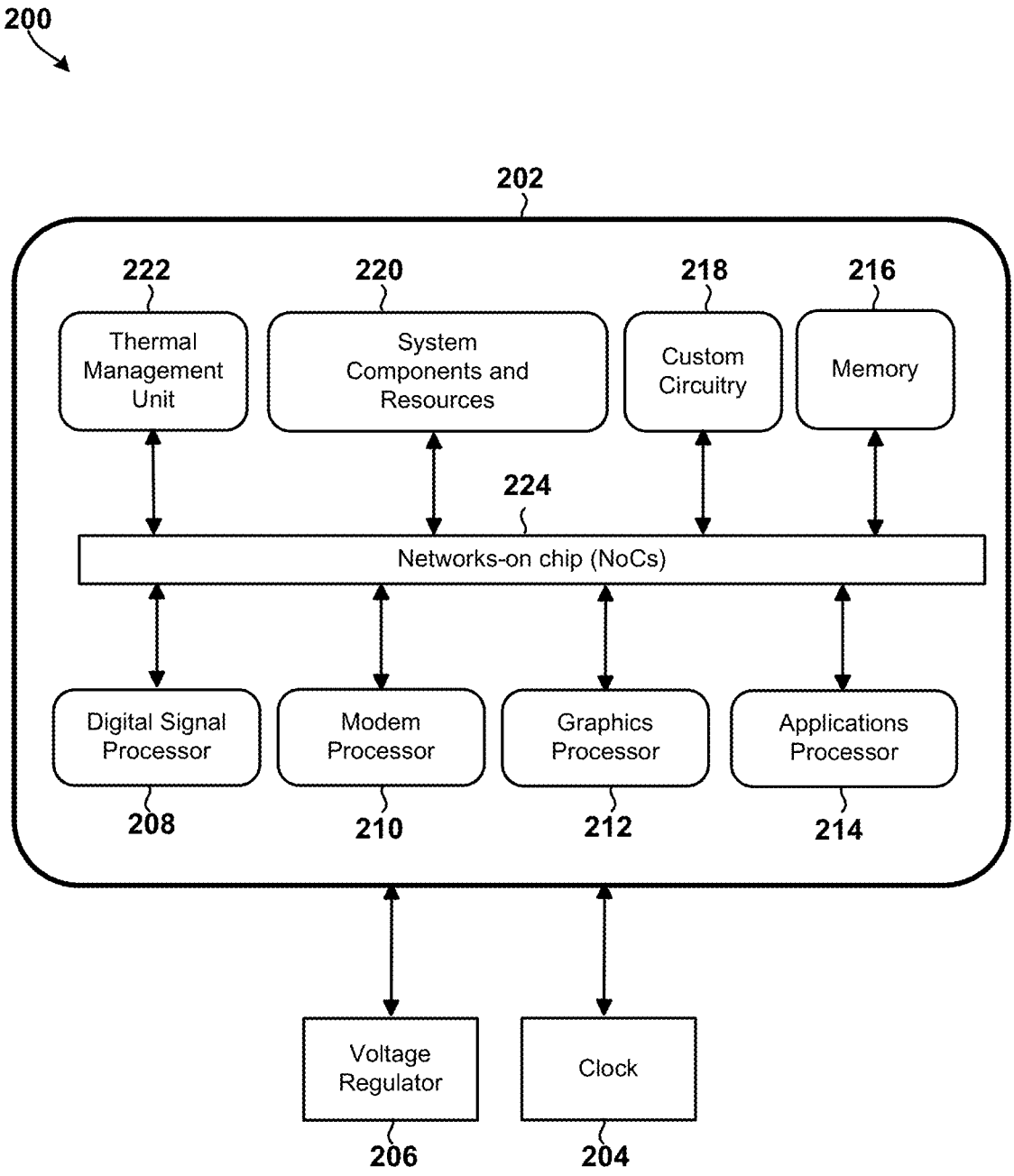
FIGS. 2A and 2B are component block diagrams illustrating example computing architectures and components that could be included in a consumer facing edge computing device configured to receive a connector in accordance with various embodiments
Figure 2B:
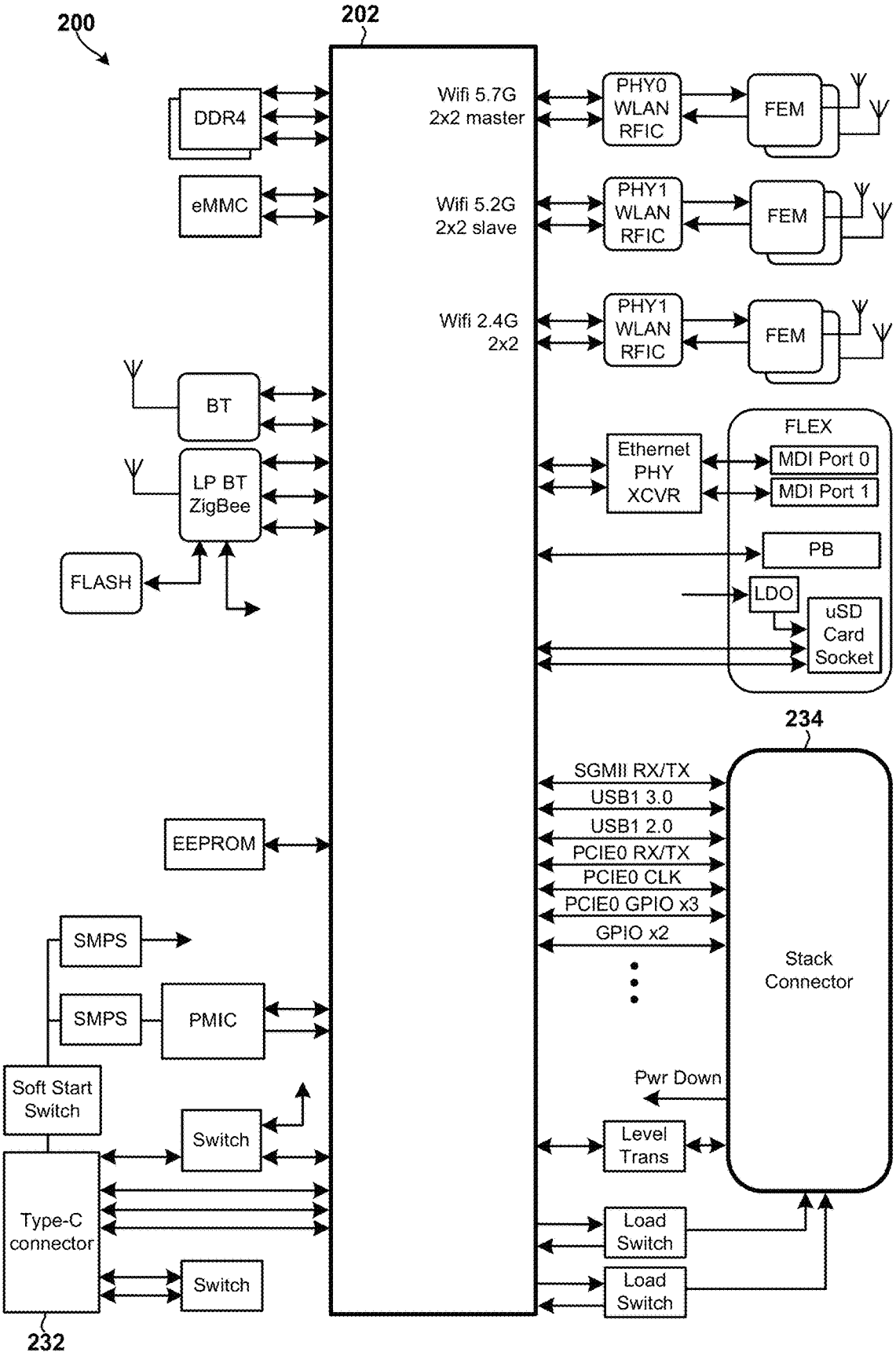

FIGS. 2A and 2B illustrate an example computing system 200 that may be used with a modular wireless communications system 100 that include a connector port (e.g., port 108, etc.) configured to receive a connector in accordance with the various embodiments.

In the example illustrated in FIG. 2A, the computing system 200 includes an SOC 202, a clock 204, and a voltage regulator 206. The SOC 202 may include a digital signal processor (DSP) 208, a modem processor 210, a graphics processor 212, an application processor 214 connected to one or more of the processors, memory 216, custom circuitry 218, system components and resources 220, a thermal management unit 222, and an interconnection/bus module 224. The SOC 202 may operate as central processing unit (CPU) that carries out the instructions of software application programs by performing the arithmetic, logical, control and input/output (I/O) operations specified by the instructions.

The thermal management unit 222 may be configured to monitor and manage the device's junction temperature, surface/skin temperatures and/or the ongoing consumption of power by the active components that generate thermal energy in the device. The thermal management unit 222 may determine whether to throttle the performance of active processing components (e.g., CPU, GPU, LCD brightness), the processors that should be throttled, the level to which the frequency of the processors should be throttled, when the throttling should occur, etc.

The system components and resources 220 and custom circuitry 218 may manage sensor data, analog-to-digital conversions, wireless data transmissions, and perform other specialized operations, such as decoding data packets and processing video signals. For example, the system components and resources 220 may include power amplifiers, voltage regulators, oscillators, phase-locked loops, peripheral bridges, temperature sensors (e.g., thermally sensitive resistors, negative temperature coefficient (NTC) thermistors, resistance temperature detectors (RTDs), thermocouples, etc.), semiconductor-based sensors, data controllers, memory controllers, system controllers, access ports, timers, and other similar components used to support the processors and software clients running on a device. The custom circuitry 218 may also include circuitry to interface with other computing systems and peripheral devices, such as wireless communication devices, external memory chips, etc.

Each processor 208, 210, 212, 214 may include one or more cores, and each processor/core may perform operations independent of the other processors/cores. For example, the SOC 202 may include a processor that executes a first type of operating system (e.g., FreeBSD, LINUX, OS X, etc.) and a processor that executes a second type of operating system (e.g., MICROSOFT WINDOWS 10). In addition, any or all of the processors 208, 210, 212, 214 may be included as part of a processor cluster architecture (e.g., a synchronous processor cluster architecture, an asynchronous or heterogeneous processor cluster architecture, etc.).

The processors 208, 210, 212, 214 may be interconnected to one another and to the memory 218, system components and resources 220, and custom circuitry 218, and the thermal management unit 222 via the interconnection/bus module 224. The interconnection/bus module 224 may include an array of reconfigurable logic gates and/or implement a bus architecture (e.g., CoreConnect, AMBA, etc.). Communications may be provided by advanced interconnects, such as high-performance networks-on chip (NoCs).

The SOC 202 may further include an input/output module (not illustrated) for communicating with resources external to the SOC, such as the clock 204 and the voltage regulator 206. Resources external to the SOC (e.g., clock 204, etc.) may be shared by two or more of the internal SOC processors/cores.

In addition to the SOC 202 discussed above, the various embodiments may include or may be implemented in a wide variety of computing systems, which may include a single processor, multiple processors, multicore processors, or any combination thereof.

With reference to FIG. 2B, the computing system 200 may include a type-C connector 232 and a stack connector 234, each of which may correspond to and/or may be used in conjunction with the connector ports 108-112 and 206 illustrated in FIG. 1B. In some embodiments, the type-C connector 232 may be a standardized or modified universal serial bus (USB) Type-C or USB-C® connector, which may be 24-pin USB connector system that includes two-fold rotationally-symmetrical connector.

The type-C connector 232 and/or stack connector 234 may include interconnection/bus module with various data and control lines for communicating with the SOC 202. The type-C connector 232 and/or stack connector 234 may also expose systems buses and resources of a SOC 202 or computing device 200 in a manner that allows the chip or computing system to attach to an additional unit to include additional features, functions or capabilities, but which preserves the performance and integrity of the original SOC 202 or computing device 200. The type-C connector 232 and/or stack connector 234 may include proprietary or custom connector pin-outs that allow for stacking interfaces and/or for the device to be retrofitted after deployment to expand its capabilities. This allows the device to have a longer life cycle, and for the manufacturer to obtain additional revenues from accessory sales, keep the baseline cost of the product down, and sell in a cheaper market with the option to upsell later with additional add-on features.

The type-C connector 232 and/or stack connector 234 may include or control various system busses and data/control lines, such as serial gigabit media-independent interface (SGMII), universal serial bus (USB), peripheral component interconnect express (PCIe), general-purpose input/output (GPIO), etc. The stack connector 234 may also include links to a dual bidirectional inter-integrated circuit ($I^2C$) bus and SMBus voltage-level translator (e.g., Level Trans 236) and various load switches.

Figure 3A:
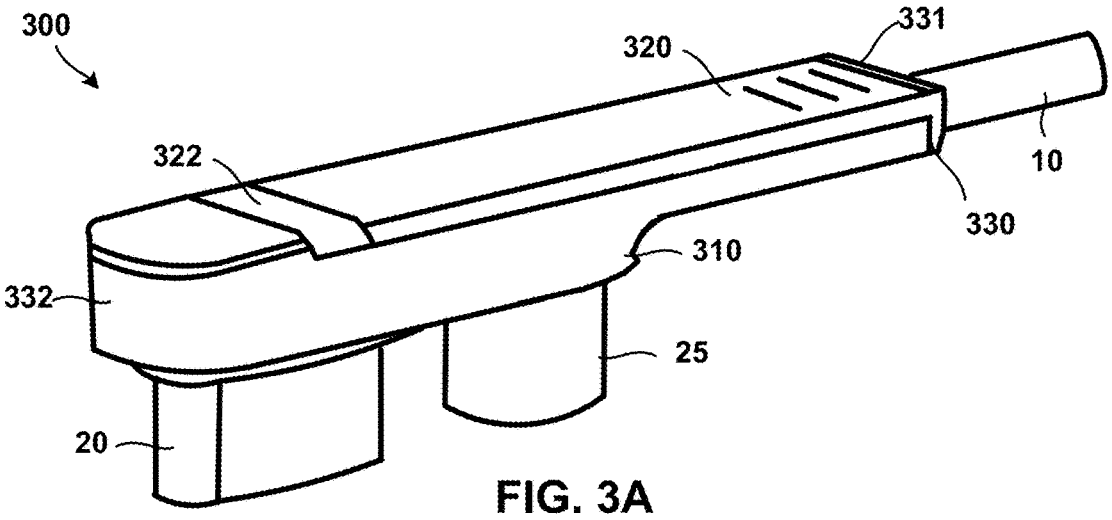
FIGS. 3A and 3B are perspective views of a connector head assembly for an electrical cable with a receptacle connector in accordance with various embodiments.
Figure 3B:
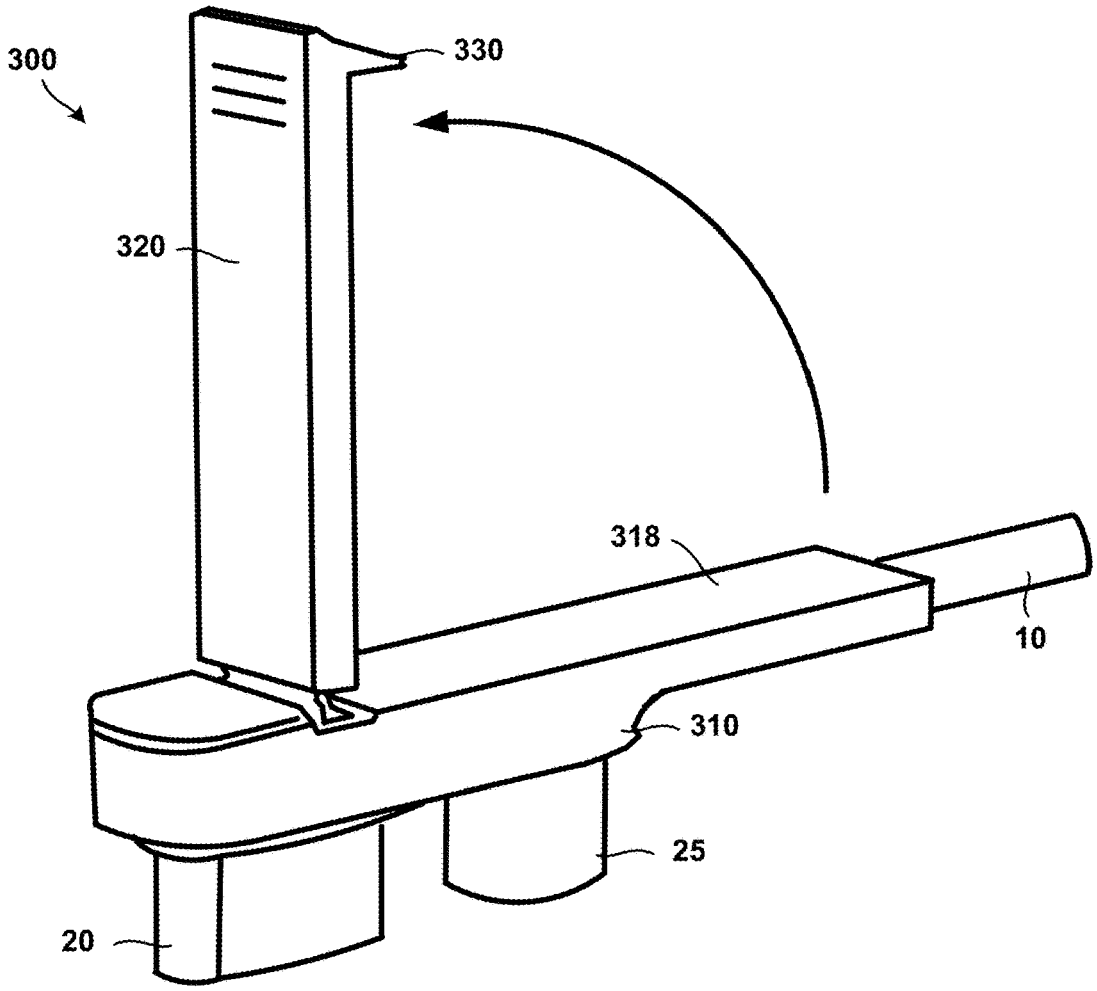

FIGS. 3A and 3B illustrate a connector head assembly 300 for an electrical cable 10 with at least one receptacle connector 20, 25 in accordance with various embodiments. The connector head assembly 300 is configured to couple with the USB-C type female connector port (e.g., 114 in FIG. 1C) and the auxiliary power port (e.g., 116 in FIG. 1C). In particular, the connector head assembly 300 is configured to be more easily removed from the narrow channel (e.g., 118) formed in the housing base (e.g., 106) through the use of a pull tab 320 that is incorporated into or added onto the connector head assembly 300.

Various embodiments provide a connector head assembly 300 for an electrical cable 10 attached to one or more receptacle connectors 20, 25. The connector head assembly 300 may include an elongate overmold 310 and a pull tab 320. Because the pull tab 320 may pivot relative to the elongate overmold 310, the pull tab 320 may provide better leverage for separating (i.e., by pulling) the connector head assembly 300 from the housing base (e.g., 106). The elongate overmold 310 may have a longitudinal extent that is longer than a height or width thereof. Also, the elongate overmold 310 may be configured to encase a terminal end of the electrical cable 10 coupled to the receptacle connector(s) 20, 25 inside the elongate overmold 310. The terminal end of the electrical cable 10 is situated at one end or extremity of the electrical cable 10.

The elongate overmold 310 and the pull tab 320 may be integrally formed (i.e., formed together as one piece) such that the pivotal attachment 322 of the pull tab 320 is formed as a living hinge integrated into an outer surface of the elongate overmold 320. As used herein, the term "living hinge" refers to a thin flexible hinge integrally formed with and made from the same material as the two more rigid pieces it connects. For example, an inner portion of an otherwise continuous piece of material may be grooved, weakened, or thinned such that two portions of the otherwise continuous piece of material on opposite sides of the inner portion may pivot relative to one another as the inner portion bends. Alternatively, other forms of hinge-type structure may be provided between the elongate overmold 310 and the pull tab 320 to provide a pivotal arrangement.

The pull tab 320 may include a handle 330 at a first end 331 that is remote from an opposed second end 332 where the pull tab 320 pivotally attaches to the elongate overmold 310. Also, the pull tab 320 may pivot from an open position (see FIG. 3B), in which the pull tab 320 extends away from an upper surface 318 of the elongate overmold 310, to a closed position (see FIG. 3A), in which the pull tab 320 extends parallel to the longitudinal extent of the elongate overmold 310. At least a portion of the handle 330 is configured to sit below an upper surface 318 of the elongate overmold 310 when the handle is in the closed position.

In various embodiments, the elongate overmold 310 may be further configured to receive the electrical cable 10 through an aperture in a first end 331 of the elongate overmold 310. The electrical cable 10 may be configured to extend through the aperture in the first end 331, parallel to the longitudinal extent of the elongate overmold 310. Also, the elongate overmold 310 may be further configured to hold at least one receptacle connector 20, 25 extending from a bottom side of the elongate overmold 310 near a second end 332 thereof that is opposed to the first end 331.

The elongated overmold 310 may also function as a strain relief for cable 10 providing additional structural integrity. In this way, without the elongated overmold 310, the cable 10 would often be forced to form a ninety-degree bend since the cable 10 is generally configured to extend perpendicular to an insertion axis of the receptacle connectors 20, 25. Such bending in the cable 10 may strain and eventually break the outer sheathing Thus, the elongated overmold 310 may prevent such strain and breaking.

FIGS. 4A-4D illustrate a connector head assembly 400 for an electrical cable 10 with at least one receptacle connector 20, 25 in accordance with various embodiments. The connector head assembly 400 is configured to couple with the USB-C type female connector port (e.g., 114 in FIG. 1C) and the auxiliary power port (e.g., 116 in FIG. 1C). In particular, the connector head assembly 400 is configured to be more easily removed from the narrow channel (e.g., 118 in FIG. 1B) formed in the housing base (e.g., 106 in FIGS. 1A-1C) through the use of a pull tab 420 that is incorporated into the connector head assembly 400. The connector head assembly 400 may include one or more of the features described above with regard to the connector head assembly 300, described above with regard to FIGS. 3A and 3B.

Figure 4A:
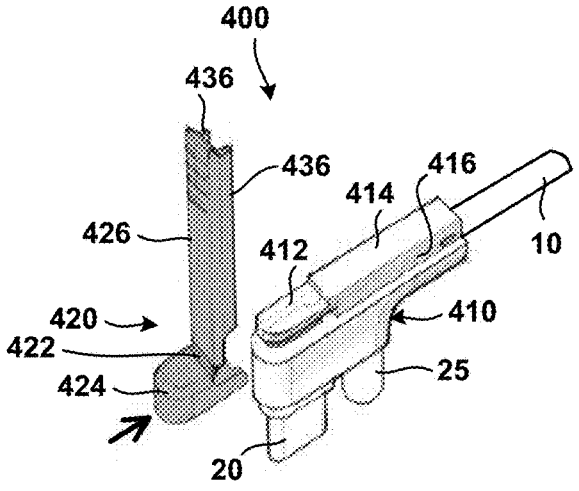
FIGS. 4A, 4B, and 4C are perspective views of a connector head assembly for an electrical cable with a receptacle connector in accordance with various embodiments.
Figure 4B:
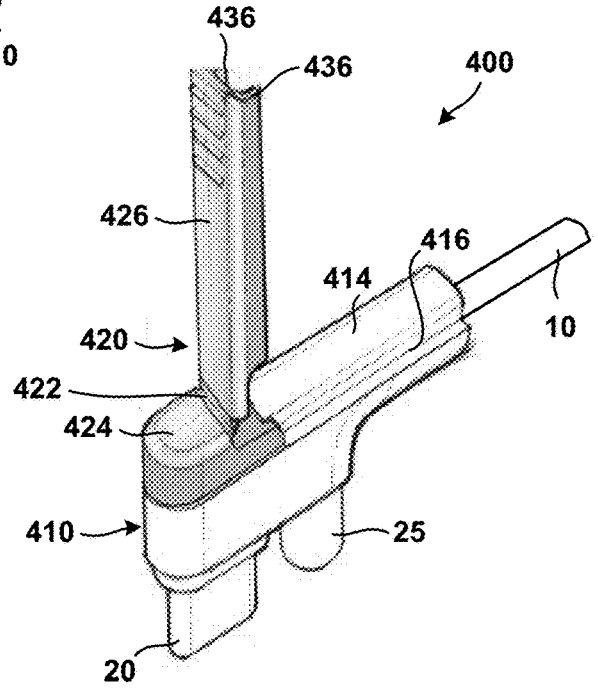
Figure 4C:
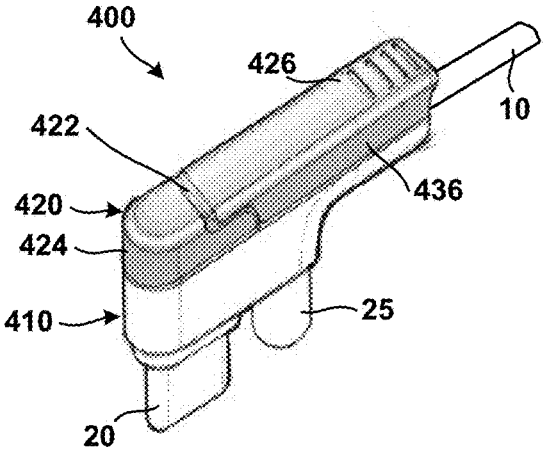
Figure 4D:
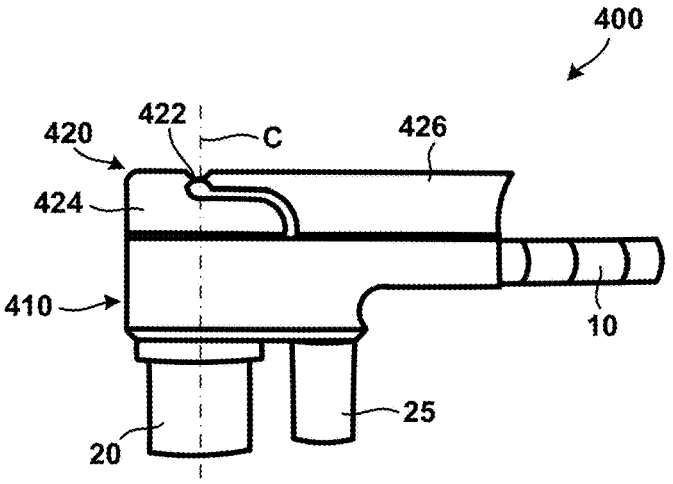
FIG. 4D is a side view of the connector head assembly in FIGS. 4A-4C in accordance with various embodiments.
Figure 5A:
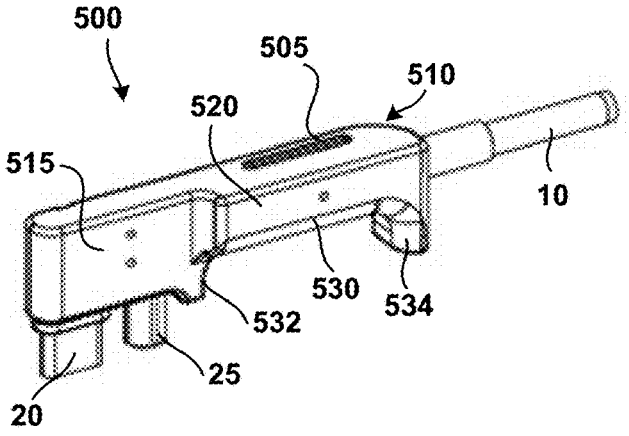
FIGS. 5A-5C are perspective views of a connector head assembly for an electrical cable with a receptacle connector in accordance with various embodiments.
Figure 5B:
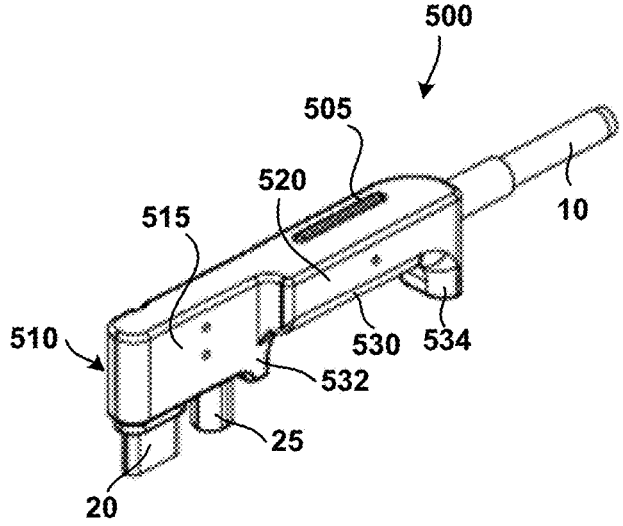
Figure 5C:
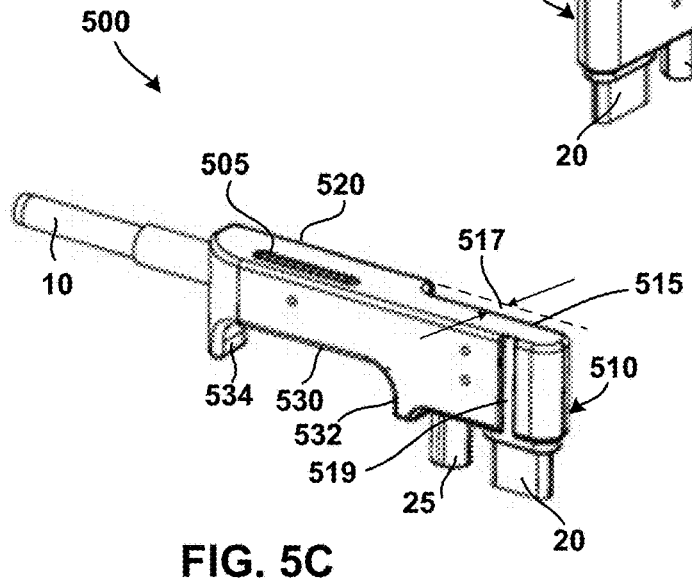
Figure 5D:
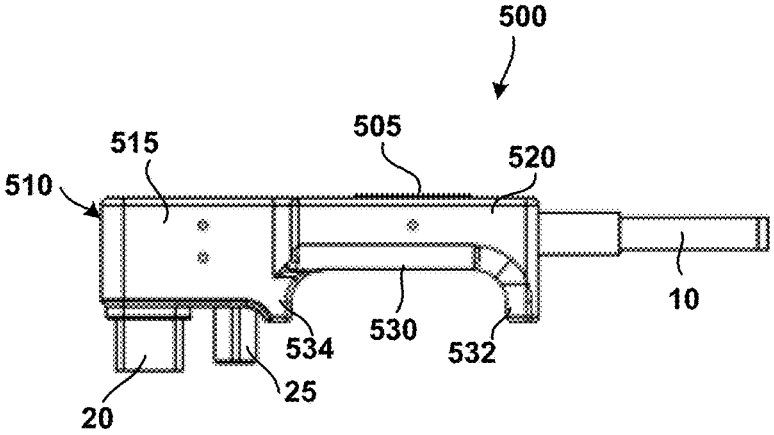
FIG. 5D is a side view of the connector head assembly in FIGS. 5A-5C in accordance with various embodiments.

In some embodiments, the pull tab 420 may be formed as a separate part from the elongate overmold 410 and releasably attaches to the elongate overmold 410. The elongated overmold 410 also functions as a strain relief for cable 10 providing additional structural integrity. The pull tab 420 may be formed by an attachment portion 424 and a pivotal portion 426 connected by a pivot joint 422. Also, the attachment portion 424 of the pull tab 420 may slide onto a mating structure 412 of the elongate overmold, preventing relative movement between the attachment portion 424 and the elongate overmold 410 in a direction perpendicular to longitudinal extent of the elongate overmold 410. The pull tab 420 may include the attachment portion 424 that is configured to remain stationary relative to the elongate overmold 410, and a pivotal portion 426 that may be configured to pivot relative to the elongate overmold 410. The attachment portion 424 and the pivotal portion 426 may be integrally formed such that the pivotal attachment of the pull tab 420 is formed as a living hinge attaching the attachment portion 424 to the pivotal portion 426. The pivotal portion 426 may be configured to pivot into a closed position (see FIG. 4C) in which the pivotal portion 426 covers an upper surface 414 and at least one side surface 416 of the elongate overmold. At least one side wall 436 may be configured to sit below an upper surface 414 of the elongate overmold 410 when the pivotal portion is in the closed position (FIG. 4C). Two opposed side walls 436 may be configured to sit below an upper surface 414 of the elongate overmold 410 when the pivotal portion 426 is in the closed position.

In some embodiments, a position of the pivot joint 422 along the longitudinal axis of the elongate overmold 410 may be aligned with a centerline C of the receptacle connector 20. In this way, when the pivotal portion 426 is in the open position, the pull tab 420 will apply a centerline force for more easily removing the connector head assembly 400 from the receptacle (e.g., 114).

FIGS. 5A-5D illustrate a connector head assembly 500 for an electrical cable 10 with an overmold assembly 510 and at least one receptacle connector 20, 25 in accordance with various embodiments. The connector head assembly 500 is configured to couple with the USB-C type female connector port (e.g., 114 in FIG. 1C) and the auxiliary power port (e.g., 116 in FIG. 1C). In particular, the connector head assembly 500 is configured to be more easily removed from the narrow channel (e.g., 118 in FIG. 1B) formed in the housing base (e.g., 106 in FIGS. 1A-1C) through the use of a U-shaped recess 530 that is incorporated into an underside of the connector head assembly 500. The U-shaped recess 530 may be used to help remove the connector head assembly 500 after it is inserted. The connector head assembly 500 may include one or more of the features described above with regard to the connector head assemblies 300 and 400, described above with regard to FIGS. 3A, 3B, and 4A-4D. The U-shaped arch 530, which is formed on an underside of the connector head assembly 500, may have a distal side 532 and a proximal side 534 that together form a cavity on the underside of the connector head assembly 500. The U-shaped arch 530 may be sized to allow a user to get a finger under or into the U-shaped arch 530, between the distal and proximal sides 532, 534, to gain leverage on the connector head assembly 500 and remove it from the USB-C type female connector port (e.g., 114) and the auxiliary power port (e.g., 116). The cavity under the U-shaped arch 530 may be sized and configured to allow a finger (e.g., a thumb) to at least partially fit inside and pull up on the connector head assembly 500 from an underside portion.

In some embodiments, the overmold assembly 510 may include a narrow distal head portion 515 and a wider proximal end portion 520. The narrow distal head portion 515 is configured to fit within the narrow channel (e.g., 118 in FIG. 1C) on the bottom of the housing base (e.g., 106 in FIG. 1C). In contrast, the wider proximal end portion 520 may not fit within the narrow channel In this way, the wider proximal end portion 520 may be wider than the narrow distal head portion 515 by a width difference 517. The width difference 517 may create more surface area inside the U-shaped arch 530, which may allow a user to gain better leverage in separating the connector head assembly 500 from the housing base (e.g., 106 in FIGS. 1A-1C). Also, that added material included in the wider proximal end portion 520 may provide more rigidity to the overall connector head assembly 500. In addition, the connector head assembly 500 is configured to mechanical rigidity to the connector. In addition, an upper surface of the overmold assembly 510 may include a ridge or gripping surface 505 that may also help a user gain purchase on the overmold assembly 510.

In some embodiments, the connector head assembly 500 may include a key 519, which may prevent inadvertent use with another device. The key 519 may be a slot formed into in a lateral side of the elongate overmold 510, and extending in a direction perpendicular to longitudinal extent of the elongate overmold 510. The narrow channel (e.g., 118 in FIG. 1C) on the bottom of the housing base may include a complementary protrusion that is configured to slide into and mate with the slot of the key 519. Alternatively, the narrow channel may have the slot and the elongate overmold 510 may include a mating protrusion configured to slide into the slot.

Figure 6:
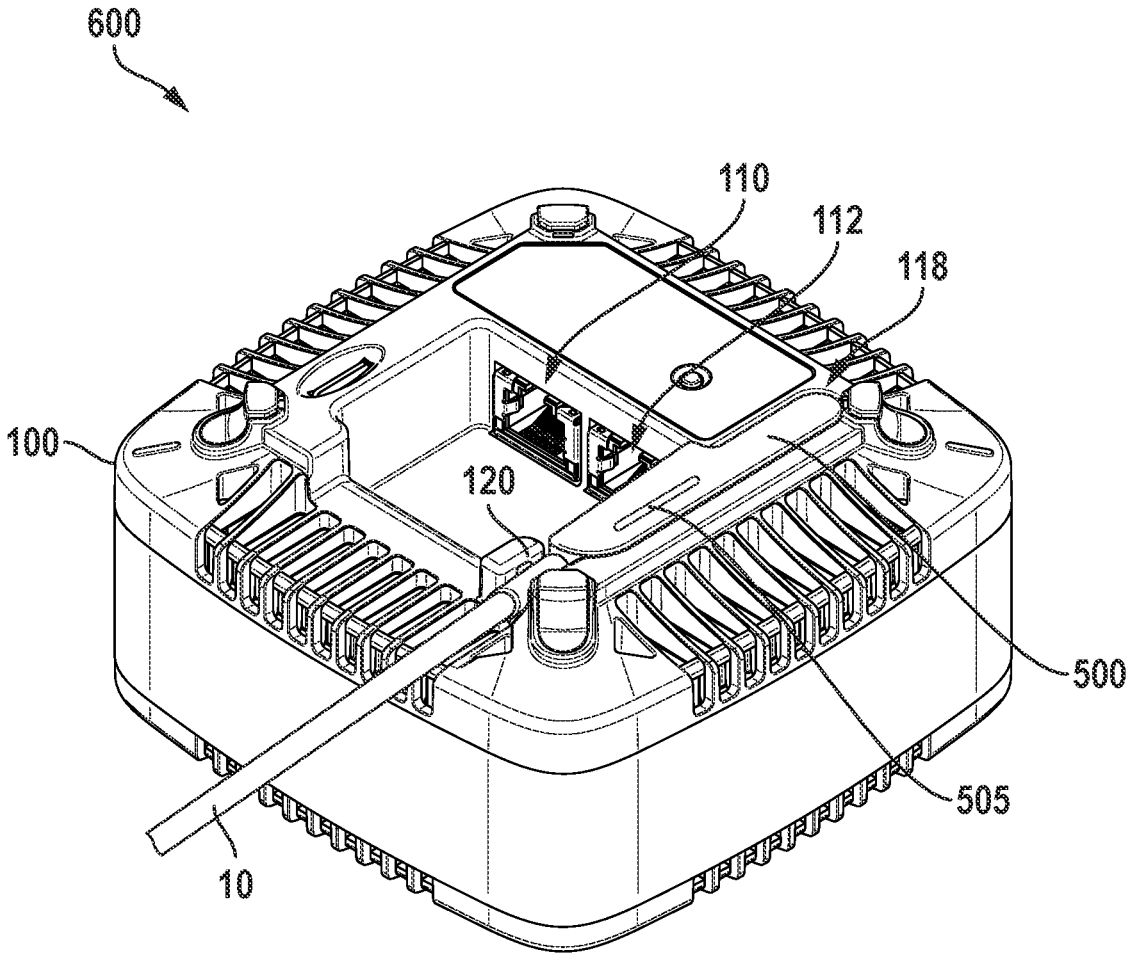
FIG. 6 is a bottom perspective view of a consumer facing edge computing device that could be configured to receive a connector in accordance with various embodiments.

FIG. 6 illustrates the connector head assembly 500 fully seated (i.e., plugged into) the narrow slot 118 of the housing base 106, in accordance with various embodiments. The house base 106 may additionally include a cable holder 120, which is a wire slot configured to snuggly receive and hold the electrical cable 10 inserted therein.

The processors discussed in this application may be any programmable microprocessor, microcomputer or multiple processor chip or chips that can be configured by software instructions (applications) to perform a variety of functions, including the functions of the various embodiments described below. In some devices, multiple processors may be provided, such as one processor within an SOC dedicated to wireless communication functions and one processor within an dedicated to running other applications. Software applications may be stored in the device's memory before they are accessed and loaded into the processor. The processors may include internal memory sufficient to store the application software instructions.

As used in this application, the terms "component," "module," "system," and the like are intended to include a computer-related entity, such as, but not limited to, hardware, firmware, a combination of hardware and software, software, or software in execution, which are configured to perform particular operations or functions. For example, a component may be, but is not limited to, a process running on a processor, a processor, an object, an executable, a thread of execution, a program, and/or a computer. By way of illustration, both an application running on a wireless device and the wireless device may be referred to as a component. One or more components may reside within a process and/or thread of execution and a component may be localized on one processor or core and/or distributed between two or more processors or cores. In addition, these components may execute from various non-transitory computer readable media having various instructions and/or data structures stored thereon. Components may communicate by way of local and/or remote processes, function or procedure calls, electronic signals, data packets, memory read/writes, and other known network, computer, processor, and/or process related communication methodologies.

A number of different cellular and mobile communication services and standards are available or contemplated in the future, all of which may implement and benefit from the various embodiments. Such services and standards include, e.g., third generation partnership project (3GPP), LTE systems, third generation wireless mobile communication technology (3G), fourth generation wireless mobile communication technology (4G), fifth generation wireless mobile communication technology (5G), global system for mobile communications (GSM), universal mobile telecommunications system (UMTS), 3GSM, general Packet Radio service (GPRS), code division multiple access (CDMA) systems (e.g., cdmaOne, CDMA1020™), enhanced data rates for GSM evolution (EDGE), advanced mobile phone system (AMPS), digital AMPS (IS-136/TDMA), evolution-data optimized (EV-DO), digital enhanced cordless telecommunications (DECT), Worldwide Interoperability for Microwave Access (WiMAX), wireless local area network (WLAN), Wi-Fi Protected Access I & II (WPA, WPA2), and integrated digital enhanced network (iDEN). Each of these technologies involves, for example, the transmission and reception of voice, data, signaling, and/or content messages. It should be understood that any references to terminology and/or technical details related to an individual telecommunication standard or technology are for illustrative purposes only, and are not intended to limit the scope of the claims to a particular communication system or technology unless specifically recited in the claim language.

Various embodiments illustrated and described are provided merely as examples to illustrate various features of the claims. However, features shown and described with respect to any given embodiment are not necessarily limited to the associated embodiment and may be used or combined with other embodiments that are shown and described. Further, the claims are not intended to be limited by any one example embodiment.

The foregoing method descriptions and the process flow diagrams are provided merely as illustrative examples and are not intended to require or imply that the operations of various embodiments must be performed in the order presented. As will be appreciated by one of skill in the art the order of operations in the foregoing embodiments may be performed in any order. Words such as "thereafter," "then," "next," etc. are not intended to limit the order of the operations; these words are used to guide the reader through the description of the methods. Further, any reference to claim elements in the singular, for example, using the articles "a," "an," or "the" is not to be construed as limiting the element to the singular.

Various illustrative logical blocks, modules, components, circuits, and algorithm operations described in connection with the embodiments disclosed herein may be implemented as electronic hardware, computer software, or combinations of both. To clearly illustrate this interchangeability of hardware and software, various illustrative components, blocks, modules, circuits, and operations have been described above generally in terms of their functionality. Whether such functionality is implemented as hardware or software depends upon the particular application and design constraints imposed on the overall system. Skilled artisans may implement the described functionality in varying ways for each particular application, but such embodiment decisions should not be interpreted as causing a departure from the scope of the claims.

The hardware used to implement various illustrative logics, logical blocks, modules, and circuits described in connection with the embodiments disclosed herein may be implemented or performed with a general purpose processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general-purpose processor may be a microprocessor, but, in the alternative, the processor may be any conventional processor, controller, microcontroller, or state machine. A processor may also be implemented as a combination of receiver smart objects, e.g., a combination of a DSP and a microprocessor, a plurality of microprocessors, one or more microprocessors in conjunction with a DSP core, or any other such configuration. Alternatively, some operations or methods may be performed by circuitry that is specific to a given function.

In one or more embodiments, the functions described may be implemented in hardware, software, firmware, or any combination thereof. If implemented in software, the functions may be stored as one or more instructions or code on a non-transitory computer-readable storage medium or non-transitory processor-readable storage medium. The operations of a method or algorithm disclosed herein may be embodied in a processor-executable software module or processor-executable instructions, which may reside on a non-transitory computer-readable or processor-readable storage medium. Non-transitory computer-readable or processor-readable storage media may be any storage media that may be accessed by a computer or a processor. By way of example but not limitation, such non-transitory computer-readable or processor-readable storage media may include RAM, ROM, EEPROM, FLASH memory, CD-ROM or other optical disk storage, magnetic disk storage or other magnetic storage smart objects, or any other medium that may be used to store desired program code in the form of instructions or data structures and that may be accessed by a computer. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above are also included within the scope of non-transitory computer-readable and processor-readable media. Additionally, the operations of a method or algorithm may reside as one or any combination or set of codes and/or instructions on a non-transitory processor-readable storage medium and/or computer-readable storage medium, which may be incorporated into a computer program product.

The preceding description of the disclosed embodiments is provided to enable any person skilled in the art to make or use the claims. Various modifications to these embodiments will be readily apparent to those skilled in the art, and the generic principles defined herein may be applied to other embodiments without departing from the scope of the claims. Thus, the present disclosure is not intended to be limited to the embodiments shown herein but is to be accorded the widest scope consistent with the following claims and the principles and novel features disclosed herein.

What is claimed is:

1. A connector head assembly for an electrical cable attached to one or more receptacle connectors, the connector head assembly comprising:

an elongate overmold having a longitudinal extent that is longer than a height or width thereof, wherein the elongate overmold is configured to encase a terminal end of the electrical cable coupled to the one or more receptacle connectors inside the elongate overmold; and a pull tab pivotally attached to the elongate overmold on an upper surface thereof, wherein a pulling force applied to the pull tab is configured to separate the one or more receptacle connectors from a receptacle in which the one or more receptacle connectors are configured to be held, wherein an attachment portion of the pull tab slides onto a mating structure of the elongate overmold in a first direction, preventing relative movement between the attachment portion and the elongate overmold in a direction of the pulling force when the pulling force is applied to the pull tab.

2. The connector head assembly of claim 1, wherein the attachment portion and the pull tab are integrally formed such that the pivotal attachment of the pull tab is formed as a living hinge integrated into an outer surface of the attachment portion.

3. The connector head assembly of claim 1, wherein the first direction is parallel to the longitudinal extent.

4. The connector head assembly of claim 3, wherein the pull tab pivots from an open position, in which the pull tab extends away from the upper surface of the elongate overmold, to a closed position, in which the pull tab extends parallel to the longitudinal extent.

5. The connector head assembly of claim 4, wherein at least a portion of the pull tab is configured to sit below the upper surface of the elongate overmold when the pull tab is in the closed position.

6. The connector head assembly of claim 1, wherein the pull tab is formed as a separate part from the elongate overmold and releasably attaches to the elongate overmold.

7. The connector head assembly of claim 1, wherein the pull tab includes the attachment portion that is configured to remain stationary relative to the elongate overmold, and a pivotal portion that is configured to pivot relative to the elongate overmold.

8. The connector head assembly of claim 7, wherein the attachment portion and the pivotal portion are integrally formed such that the pivotal attachment of the pull tab is formed as a living hinge attaching the attachment portion to the pivotal portion.

9. The connector head assembly of claim 7, wherein the pivotal portion is configured to pivot into a closed position in which the pivotal portion covers the upper surface and at least one side surface of the elongate overmold.

10. The connector head assembly of claim 9, wherein the pivotal portion includes at least one side wall, wherein the at least one side wall is configured to sit below the upper surface of the elongate overmold when the pivotal portion is in the closed position.

11. The connector head assembly of claim 9, wherein the pivotal portion includes two opposed side walls, wherein the two opposed side walls are configured to sit below the upper surface of the elongate overmold when the pivotal portion is in the closed position.

12. The connector head assembly of claim 1, wherein the elongate overmold is further configured to receive the electrical cable through an aperture in a first end of the elongate overmold, wherein the electrical cable is configured to extend through the aperture, parallel to the longitudinal extent.

13. The connector head assembly of claim 1, wherein the elongate overmold is further configured to hold the one or more receptacle connectors extending from a bottom side of the elongate overmold near a second end thereof that is opposed to a first end.

14. The connector head assembly of claim 1, wherein the one or more receptacle connectors are a USB-C power bank connector.

15. A connector head assembly for an electrical cable attached to one or more receptacle connectors, the connector head assembly comprising:

an elongate overmold having a longitudinal extent that is longer than a height or width thereof, wherein the elongate overmold is configured to encase a terminal end of the electrical cable coupled to the one or more receptacle connectors inside the elongate overmold, wherein the terminal end of the one or more receptacle connectors protrude from a first portion of an underside of the elongate overmold in a direction perpendicular to the longitudinal extent, wherein a second portion of the underside includes a cavity configured to receive a portion of a finger for applying a force in the direction perpendicular to the longitudinal extent, wherein the width of the elongate overmold is wider at the second portion than at the first portion providing a wider leverage surface on an underside of the elongate overmold for a user to engage and separate the terminal end from a receptacle.

16. The connector head assembly of claim 15, wherein an arch on the underside of the elongate overmold forms the cavity.

17. The connector head assembly of claim 16, wherein the wider second portion extends an undersurface of the arch.

18. The connector head assembly of claim 15, wherein the connector head assembly is configured to fit within a channel in a housing base, wherein a lateral side of the elongate overmold includes a key element configured to mate with a matching key element in the channel of the housing base.

* * * * *